US009464452B2

(12) United States Patent
Higgs

(10) Patent No.: US 9,464,452 B2
(45) Date of Patent: Oct. 11, 2016

(54) MODULAR SAFETY RAIL SYSTEM

(71) Applicant: Philip Maurice Higgs, Reading (GB)

(72) Inventor: Philip Maurice Higgs, Reading (GB)

(73) Assignee: KEE SAFETY LIMITED, West Midlands (GB)

( * ) Notice: Subject to any disclaimer, the term of this patent is extended or adjusted under 35 U.S.C. 154(b) by 104 days.

(21) Appl. No.: 14/386,101

(22) PCT Filed: Mar. 19, 2013

(86) PCT No.: PCT/GB2013/000118

§ 371 (c)(1),
(2) Date: Sep. 18, 2014

(87) PCT Pub. No.: WO2013/140115

PCT Pub. Date: Sep. 26, 2013

(65) Prior Publication Data

US 2015/0041744 A1 Feb. 12, 2015

(30) Foreign Application Priority Data

Mar. 19, 2012 (GB) ..... 1204797.3
Dec. 10, 2012 (GB) ..... 1222120.6

(51) Int. Cl.
*E04H 12/22* (2006.01)
*E04G 21/32* (2006.01)
*E01F 13/02* (2006.01)

(52) U.S. Cl.
CPC ..... *E04H 12/2238* (2013.01); *E01F 13/02* (2013.01); *E01F 13/022* (2013.01); *E04G 21/3238* (2013.01); *E04H 12/2269* (2013.01)

(58) Field of Classification Search
CPC ..... E01F 13/02; E01F 13/022; E01F 9/0122; E01F 9/0124; E04H 17/14; E04H 17/18; E04H 17/22; E04H 12/22; E04H 12/2238; E04H 12/2253; E04G 21/3233
See application file for complete search history.

(56) References Cited

U.S. PATENT DOCUMENTS 3,776,521 A * 12/1973 Weinert ..... E01F 13/022 256/24
5,813,662 A * 9/1998 Langkruis ..... E04H 12/2246 160/135
6,554,257 B1 * 4/2003 Kenton ..... E04H 17/18 256/24
6,848,679 B2 * 2/2005 Higgs ..... E04F 11/1812 256/65.14

(Continued)

FOREIGN PATENT DOCUMENTS

AU 2009202587 A 1/2010
CA 2 472 814 A1 12/2005

(Continued)

OTHER PUBLICATIONS

International Search Report, dated Jul. 10, 2013, from corresponding PCT application.

(Continued)

*Primary Examiner* — Daniel Wiley
(74) *Attorney, Agent, or Firm* — Young & Thompson

(57) ABSTRACT

A support foot (10) for a vertical member (48) of a safety rail system includes an upper body section (14) which defines an upper surface region of the support foot and a lower body section (15) which defines a lower surface region, the two bodies having at least in part a substantially common outer periphery and each body section having extending there through a plurality of location formations (25) for supporting one or more vertical members (48) of the safety rail system.

18 Claims, 7 Drawing Sheets

(56) References Cited

U.S. PATENT DOCUMENTS

| | | | | |
|---|---|---|---|---|
| 6,981,680 | B1 | 1/2006 | Gordon et al. | |
| 7,243,450 | B2 * | 7/2007 | Dicke | G09F 15/0056 248/167 |
| 7,338,033 | B2 * | 3/2008 | Anson | E01F 13/022 256/59 |
| 7,516,816 | B2 * | 4/2009 | Higgs | E04G 21/3233 182/113 |
| 8,579,262 | B2 * | 11/2013 | Sadinsky | E04H 17/163 256/26 |
| 2005/0056741 | A1 * | 3/2005 | Higgs | E04G 21/3233 248/188.8 |
| 2005/0189005 | A1 * | 9/2005 | Smith | G09F 23/00 135/16 |
| 2005/0199774 | A1 * | 9/2005 | Reese | A45B 23/00 248/529 |
| 2007/0170411 | A1 | 7/2007 | Ribak | |
| 2007/0241255 | A1 * | 10/2007 | Dvoracek | G09F 15/0056 248/346.01 |
| 2008/0237560 | A1 | 10/2008 | Dehlsen | |

FOREIGN PATENT DOCUMENTS

| | | | |
|---|---|---|---|
| DE | 20 2004 016444 | U1 | 12/2004 |
| EP | 1 447 497 | A | 8/2004 |
| FR | 2 833 682 | A3 | 6/2003 |
| GB | 2 248 860 | A | 4/1992 |
| GB | 2 320 515 | A | 6/1998 |

OTHER PUBLICATIONS

GB Search Report, dated Mar. 6, 2013, from corresponding GB application.

* cited by examiner

MODULAR SAFETY RAIL SYSTEM

BACKGROUND OF THE INVENTION

1. Field of the Invention

This invention relates to a support foot for a modular type safety rail system and in particular, though not exclusively, to a support foot for a modular safety rail system suitable for use in providing free-standing roof edge protection.

2. Description of the Related Art

Modular type safety rail systems are well known and typically comprise safety rail sections formed from lengths of metal tubing or panels which are inter-connected at ground level by connectors which, for example, facilitate construction of two, three or four way inter-connections of safety rail sections.

Tubes serving as vertical posts of a safety rail section conventionally are supported by and secured to cast iron metal base plates. The base plates generally need to be of a robust, heavy construction thereby to provide firm support and location for the vertical posts. Many different designs of base plates have been proposed, but different designs suffer different disadvantages. Thus some are relatively expensive to manufacture whilst others do not lend themselves to ease of use, for example ease of securing the vertical posts to the base plates and/or ease of securing toe boards of different sizes or in different orientations. Other designs do not lend themselves readily to being stacked safely in a manner which is inherently adapted to resist toppling of the stacked assembly.

Furthermore, in general the known designs of base plates are not entirely satisfactory for manufacturing from recycled non-ferrous or other metallic material, for example by moulding of recycled polymeric materials such as polyvinyl chloride. Such materials commonly either lack the stiffness of cast iron or do not have sufficient strength for enabling them to be provided with satisfactory screw-threaded formations such as may be necessary in order that a safety rail can be secured properly to the base plate.

BRIEF SUMMARY OF THE INVENTION

The present invention seeks to provide an improved support foot for a modular safety rail system in which at least some of the aforedescribed disadvantages of known base plates are mitigated or overcome. The invention seeks also to provide a safety rail assembly comprising a plurality of said support feet and safety rail sections.

In accordance with one aspect of the present invention there is provided a support foot for a modular safety rail system, said support foot being adapted to provide location for a vertical member of a safety rail section and comprising:

- a support body assembly having upper and lower surface regions and an outer periphery;
- a plurality of location formations positioned inwards of said outer periphery and each extending into the support body assembly from said upper surface for location of a vertical member of a safety rail section;
- said support foot comprising two bodies to provide said support body assembly, one of said bodies being an upper body section which defines said upper surface region, the other of said bodies being a lower body section which defines said lower surface region, the two bodies having at least in part a substantially common outer periphery and said location formations each extending through at least that material that defines upper body section.

Preferably the location formations each extend through the upper body section and at least a part of the thickness of the lower body section.

A location formation may be in the form of a socket of circular or other cross-sectional shape. Preferably the cross-sectional shape and size of the socket is substantially the same as that of the cross-sectional shape and size of the vertical member which is to be located within the socket when constructing a safety rail assembly.

The location formations may extend through the whole thickness of the lower body section but more preferably terminate at a position spaced from said lower surface region whereby, in use, the lower end of a vertical member is prevented from contacting and thus potentially damaging a support surface such as that of a roof on which the support foot is positioned.

Confronting surfaces of the two bodies may be provided with one or a plurality of inter-engaging formations whereby, on assembly of the two bodies in contact with one another, the two bodies become located in a predetermined alignment. One of the confronting surfaces may be provided with a plurality of protrusion each engagable with a respective one or a plurality of recesses in the other of the confronting surfaces or each of the surfaces may be provided with a combination of recesses and protrusions.

The inter-engaging formations may be of a type which resist relative sliding movement of the two body sections in a plane substantially perpendicular to the direction in which the location formations extend through the support body assembly.

Said inter-engaging formations may serve also to resist tilting movement of the upper body section relative to the lower body section. For that purpose the inter-engaging formations preferably comprise confronting formation surfaces at least one of which extends in a direction substantially perpendicular to the direction in which the inter-engaging formations restrain relative sliding movement of the two body sections.

One or each of the confronting surfaces of the two body sections may be provided with at least one protrusion in the form of a substantially cylindrical boss for engagement within, as a close fit, the wall of a recess formed in the other of the two confronting surfaces of the body sections. Said wall also may be of a substantially cylindrical shape but that is not an essential feature for resisting toppling movement, it being sufficient that the protrusion is a close fit against one or more surface regions of a recess. Thus, in general, the present invention teaches that relative tilting of the two body sections may be inhibited by providing respective confronting surfaces of the two body sections with inter-engaging formations which are a close fit or which come into contact with one another following an initial tilting movement and thereby inhibit further relative tilting movement.

Connectors may be provided for securing together the two body sections.

Each of the bodies may be provided with a plurality of apertures which align with apertures in the other body for the purpose of locating connectors, such as bolts, whereby the two bodies may be secured relative to one another. Accordingly said connectors may be employed to inhibit relative tilting movement of the two body sections and also to prevent lifting of the upper body section away from the lower body section.

Preferably at least said lower surface region, as defined by the lower body portion, is provided with recesses aligned with the apertures for the purpose of accommodating ends of connectors, such as bolt heads or nuts, to ensure that, in use, those ends do not apply point loading to the support surface on which the support foot is positioned.

Particularly suitable materials for forming the bodies include polymeric materials, including recycled polymeric materials such as polyvinyl chloride. Alternatively however, the bodies may be formed from metallic materials such as cast iron. The bodies may be formed, for example, by casting or injection moulding techniques.

The support foot may be provided with one or more slots each for location of a toe board. Side faces of a slot may be defined solely by the upper body section or they may be defined by both of the upper and the lower body sections. The lower body section may define slot sides which do not extend fully to the lower surface of the lower body section such that, in use, material defining the lower surface acts to maintain the lower edge of a toe board spaced slightly above the support surface on which the support foot is positioned.

Preferably each location formation has associated therewith a retention means whereby a vertical member of a safety rail section may be secured against upwards removal from the support foot. Said retention means may comprise a retention means aperture which extends from the location formation in an outwards direction towards the outer periphery of the support foot in the manner in which said aperture is accessible for enabling vertical member to be secured in position subsequent to insertion of the vertical member into the location formation.

In the case of a support foot having one or more slots for a toe board, preferably a said slot is aligned with a location formation such that the retention means aperture extends to, and is accessible at, that end of the slot which lies innermost from the outer periphery of the support foot.

The retention means aperture may be a screw threaded aperture and may be provided with a retention screw, such as a grub screw, which may be brought into firm engagement with the surface of a vertical member of a safety rail section thereby to prevent ready removal of the safety rail section from the support foot. More preferably, however, and to avoid the need to form a screw thread in either of the upper and lower body sections, the retention means aperture may provide access to a retainer which is captive within the assembly of the two support foot body sections.

A captive retainer may be in the form of a tubular sleeve which is provided within the support foot at a position co-axial with a longitudinal axis of the location formation, the sleeve having an internal profile slightly greater than external profile of the vertical member such that in the assembly the sleeve surrounds the vertical member.

The sleeve may be provided with a screw threaded aperture for a screw, such as a grub screw, which can be brought to bear firmly against the vertical member such that the captive retainer acts to hold the vertical member captive relative to the support foot.

The sleeve may have a formation such as a boss which surrounds the screw threaded aperture and extends radially outwards from the sleeve whereby the boss co-operates with abutments defined by the support body to retain the screw threaded aperture of the sleeve aligned with the retention means aperture. The retention means aperture of the support body may be defined by either or each of the body sections and may be in the form of a recess provided in a said confronting surface of one or each of the body sections. Particularly if the retention means aperture is not screw threaded, the retention means aperture may be defined in part by each of the upper and lower body sections of the support foot.

The support foot may be provided with a pair of openings and/or the lower surface region may be provided with a pair of recesses to serve as handles for enabling the support foot readily to be lifted for transportation.

The upper and lower surface regions of the support body assembly may comprise inter-engagable formations whereby when one support foot is stacked upon a second support foot said inter-engaging formations resist relative sliding movement of one support foot relative to the other. Said formations may be positioned close to the outer periphery of the support body assembly whereby they serve to resist toppling of the superimposed support foot relative to the underlying support foot. More preferably said formations inter-engage in a manner substantially similar to the aforedescribed inter-engaging formations of the upper and lower body sections whereby tilting of the superimposed support foot relative to the underlying support foot is inhibited.

The present invention provides also a modular safety rail assembly comprising two safety rail sections each supported by a support foot of a type in accordance with the present invention.

The present invention, further teaches provision of at least one safely rail section tie such that two said safety rail sections may be secured to one another at a position remote from the support body, preferably within the upper 30% of the height of the safety rail sections. The tie may be of a kind which merely limits relative movement of the upper regions of adjacent support rail sections or the tie may be rigidly secured to at least one of the safety rail sections whereby it inhibits relative movement of the safety rail sections.

BRIEF DESCRIPTION OF THE DRAWINGS

Embodiments of the present invention will now be described, by way of example only, with reference to the accompanying diagrammatic drawings in which.

DETAILED DESCRIPTION OF THE PREFERRED EMBODIMENTS

Figure 1:
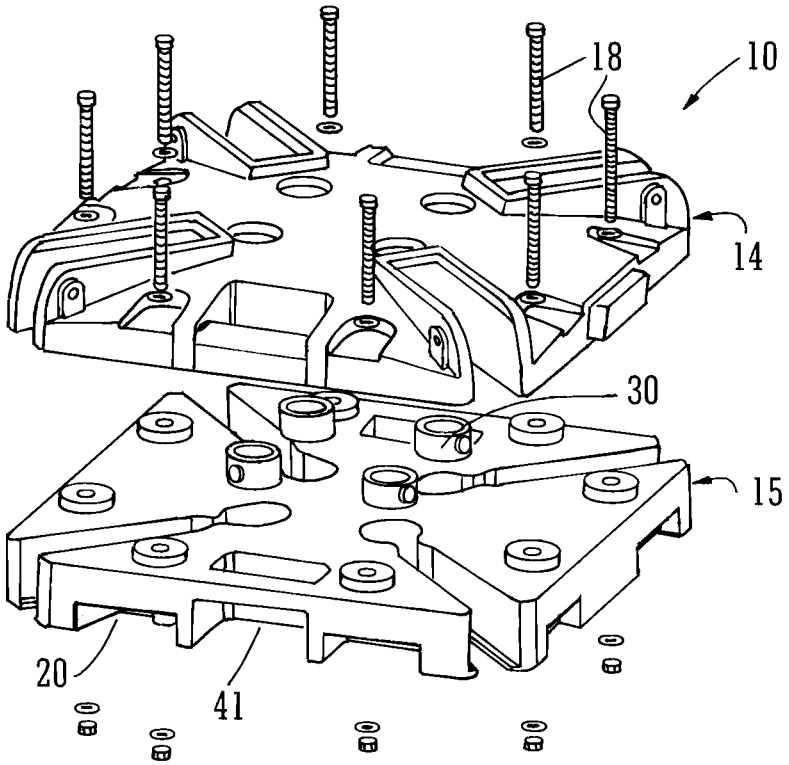
FIG. 1 is an exploded perspective view of a support foot in accordance with an embodiment of the present invention.
Figure 2:
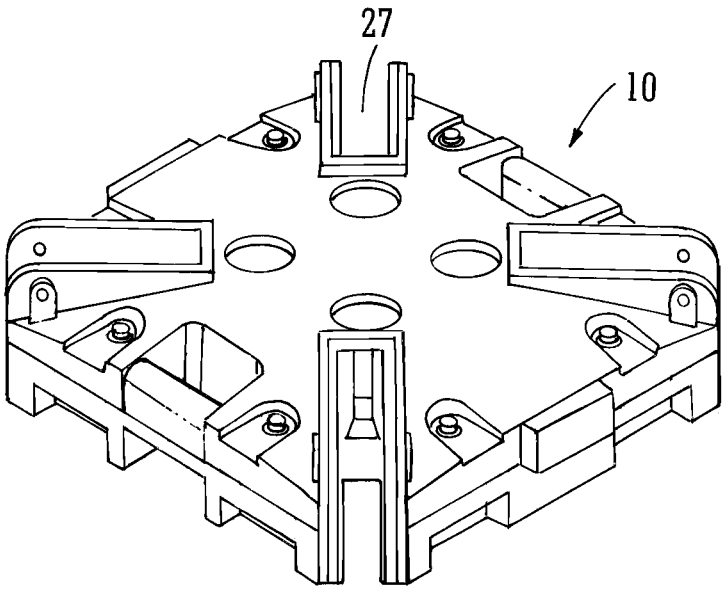
FIG. 2 is a perspective view of the support foot of FIG. 1 in an assembled condition.
Figure 3:
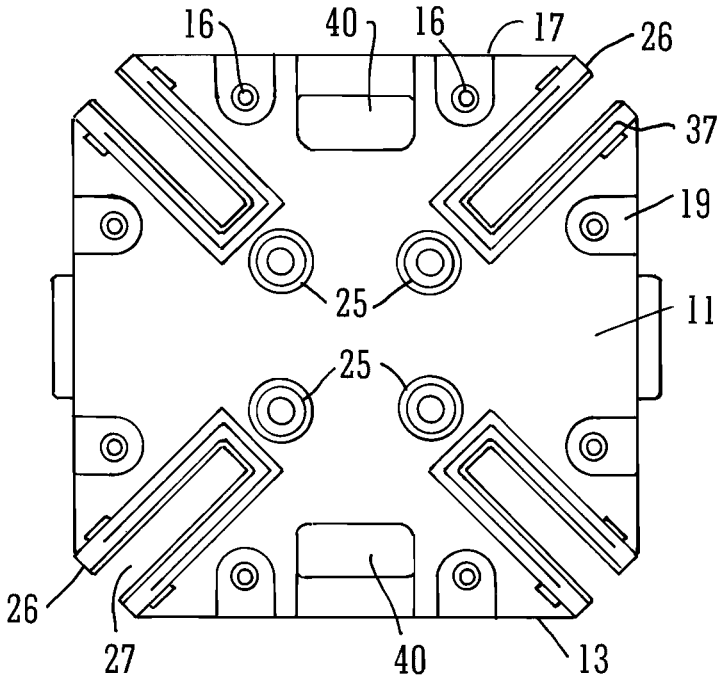
FIGS. 3 to 5 are respectively plan and side elevations of the support foot of FIG. 2.
Figure 4:
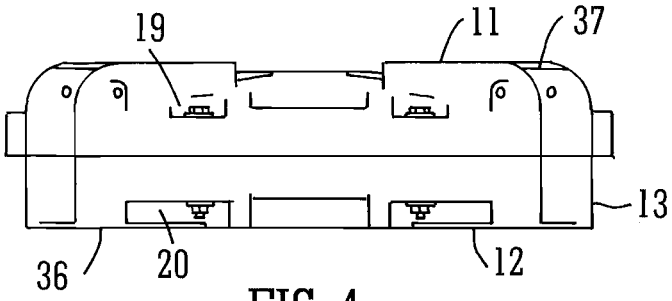
Figure 5:
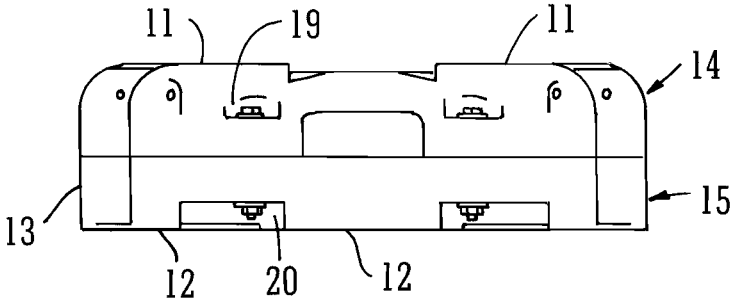
Figure 6:
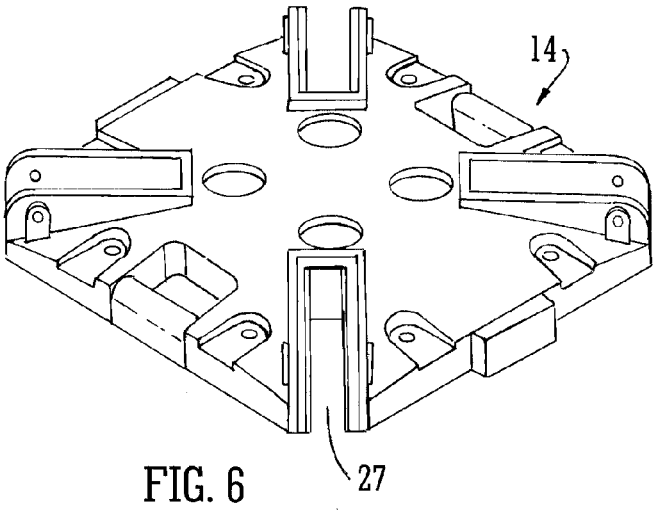
FIG. 6 is a perspective view of an upper body section of the support foot of FIG. 2.
Figure 7:
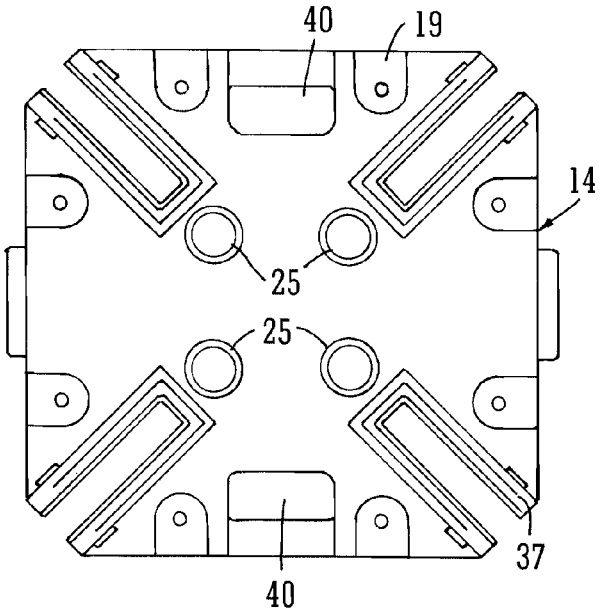
FIGS. 7 to 9 are respectively plan and side elevations of the support body section of FIG. 6.
Figure 8:
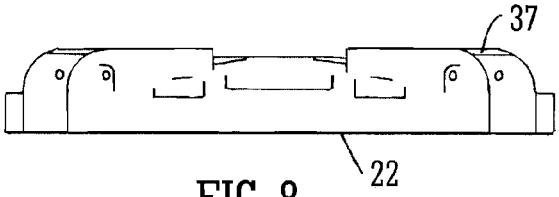
Figure 9:
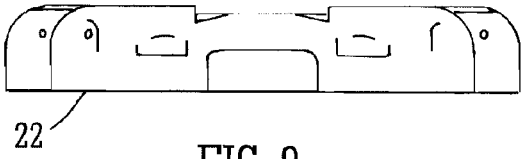
Figure 10:
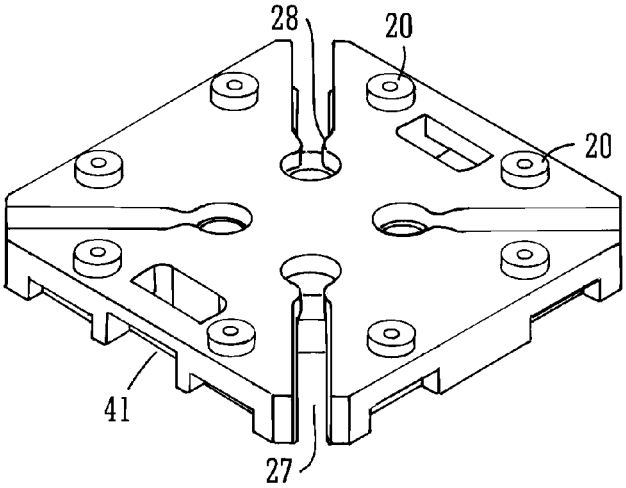
FIG. 10 is a perspective view of the lower body section of the support foot of FIG. 2.
Figure 11:
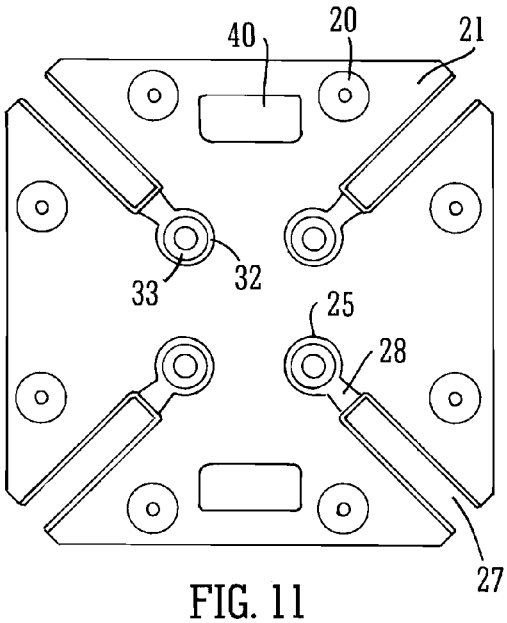
FIGS. 11 to 13 are respectively plan and side elevations of the support body section of FIG. 10.
Figure 12:
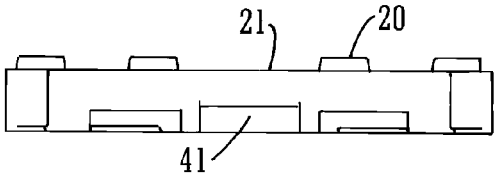
Figure 13:
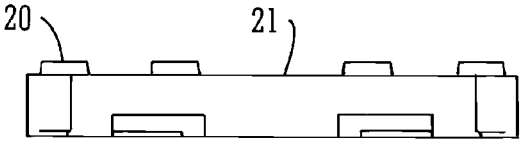

A support foot 10 (see FIGS. 2 to 5) for a modular safety rail system comprises a two-part body having substantially planar upper and lower surfaces 11,12 which each define a substantially square outer periphery 13.

The upper surface 11 is defined by an upper body section 14 (see FIGS. 1 and 6 to 9) and the lower surface 36 is defined by a lower body section 15 (see FIGS. 1 and 10 to 13). Each body section is formed by injection moulding of recycled polyvinyl chloride, in this embodiment the material having a density of approximately 1.65 g/cm$^3$.

The support foot is formed with eight apertures 16 arranged two near to each edge 17 of the support foot. Bolts 18 (see FIG. 1) are provided to extend through the apertures to secure together the two body sections.

The upper and lower surfaces 11,12, of the support foot are provided with recesses 19,20 aligned with each aperture 16 to locate bolt heads and associated nuts and washers, in particular such that the nuts and for bolts do not protrude beneath general plane of the lower surface 12 and impose, in use, any potentially damaging point loads on a roof or other such support surface.

To assist in ensuring alignment of the apertures when the two body sections are connected together by the bolts the lower body section 15 is provided with protrusions 20 in the form of bosses which extend from that surface 21 which in the assembly confronts a surface 22 of the upper body section. The confronting surface 22 of the upper body section is formed with recesses (not shown) in which the protrusions 22 are a close fit.

The protrusions 20 each comprise a cylindrical surface which extends in a direction substantially perpendicular relative to the body section surface from which it depends and accordingly, by virtue of being a close fit in a corresponding protrusion in the other body section, relative tilting movement of the two body sections is inhibited.

The support foot is formed with four uniformly spaced location sockets 25 positioned near to but spaced from the centre of the upper surface 11 and extending substantially perpendicular relative to the plane of that surface, each for location of a vertical post extending from and typically forming part of a safety rail section. Each socket extends through the upper body section and into the lower body section. Opposite sockets 25 are aligned with a line extending between opposite corners 26 of the support foot.

The support foot additionally is formed with four uniformly spaced slots 27 each for location of a toe board. Each slot extends from a corner position 26 of the support body to a position near to but spaced from one of the sockets 25. The lower body section 15 is shaped to define a passage 28 which lies adjacent the confronting surface 21 of that section, the passage extending in the form of a surface recess between the slot 27 and the nearest socket 25.

Figure 14:
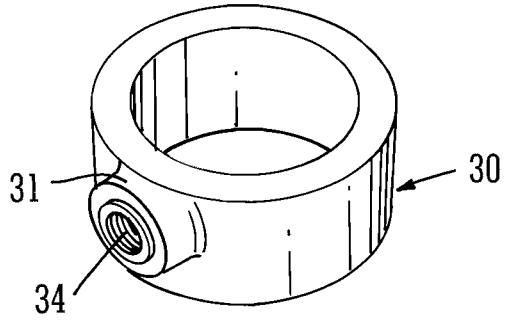
FIG. 14 is a perspective view of a safety rail section retainer sleeve.

A portion of the socket 25 defined by the lower body section has a cross-sectional shape greater than that of the portion of the socket defined by the upper body section 14 thereby to provide an annular space for location of a tubular retention sleeve 30 (see FIGS. 1 and 14) defined by the upper body section 14. The sleeve 30 has a radially outwardly extending boss 31 that locates in the aforedescribed passage 28 such that the sleeve is thereby prevented from rotation within the socket. The socket formation in the lower body section 15 is of a stepped diameter, reducing in diameter firstly to provide an annular shoulder 32 on which the sleeve may rest, and closest to the lower surface 12, an annular shoulder 33 which serves as a end stop for abutment by the lower end of a post inserted into the socket.

A screw threaded aperture 34 is formed in the boss and extends through the boss such that it is aligned with and accessible from the passage 28. Accordingly, in use, a grub screw in the sleeve aperture 34 may be tightened to bear firmly against a vertical post positioned in the socket. Because the socket portion as defined by the upper body section has a diameter less than the diameter of the retention sleeve 30 the post is held captive against vertical removal from and rotation relative to the socket.

Two opposite sides of the support foot are formed with openings 40 each aligned with recesses 41 in the lower surface to act as handle positions for lifting of the support body.

Figure 15:
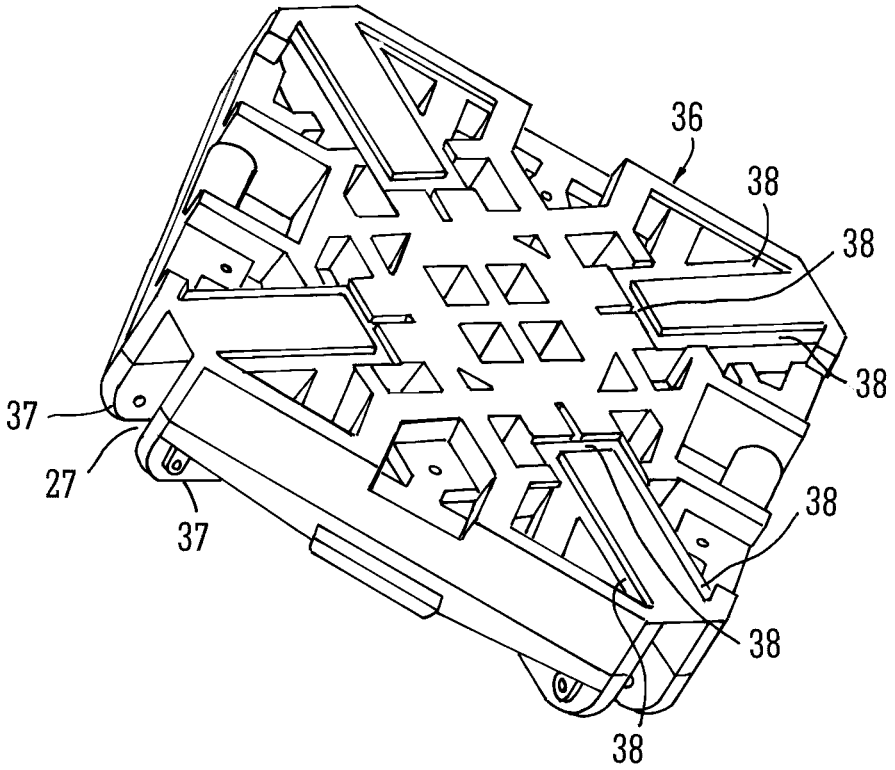
FIG. 15 is a perspective view of the support foot of FIG. 1 in an assembled condition and showing the lower surface of the lower body section.

The upper surface 11 of the upper body section 14 and the lower surface 36 of the lower body section comprise respective protrusions and depressions whereby when one support foot is stacked on top of another support foot relative sliding movement is resisted. In this embodiment the upper surface 11 comprises upwardly extending rib formations 37 aligned with the toe board slots 27 and the lower surface 36 comprises depressions in the form of channel-like recesses 38 (see FIG. 15).

Figure 16:
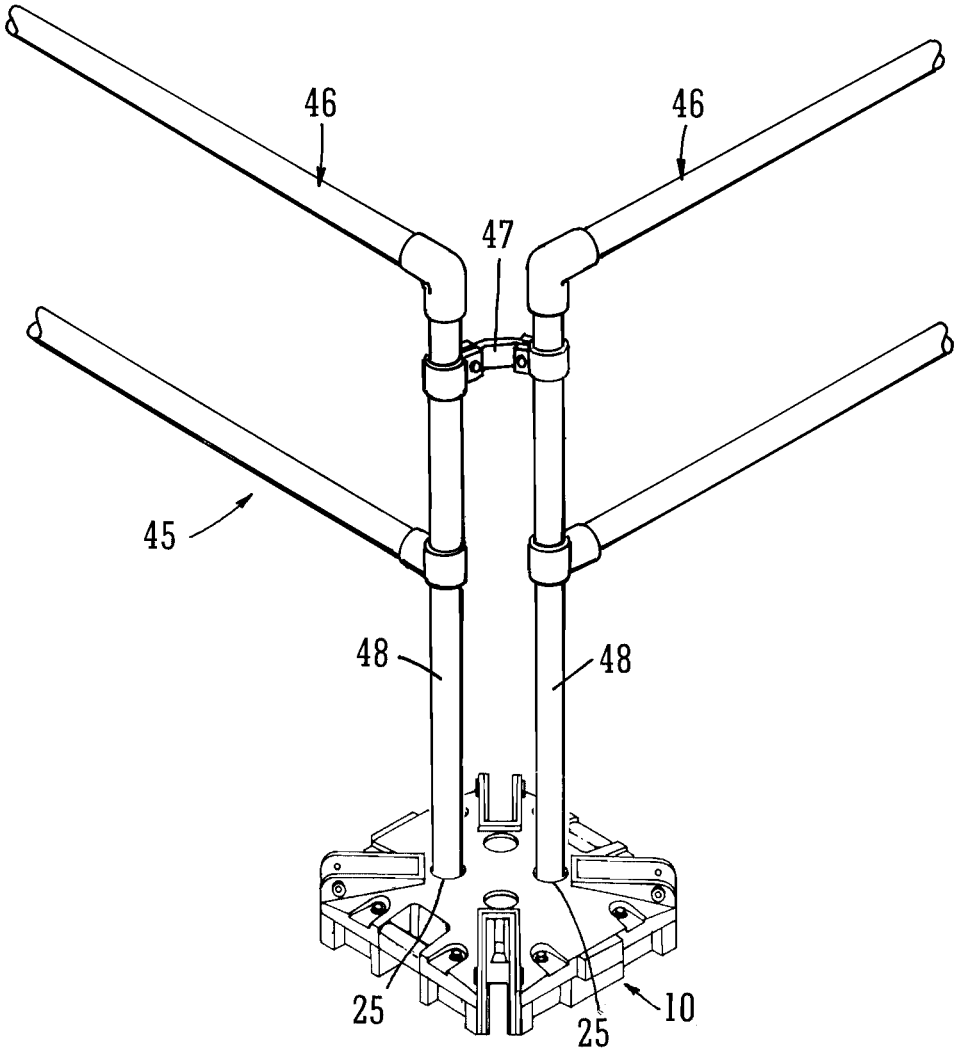
FIG. 16 is a perspective view of part of a safety rail assembly in accordance with the present invention.

An assembly 45 comprising two support rail sections 46 is shown in FIG. 16. Each support rail section has a downwardly extending post region 48 secured in a respective one of two of the support body sockets 25. Near to the upper regions of the support rail sections a tie bar 47 is secured firmly to each of the rail sections to inhibit relative movement of the two sections.

Accordingly any sideways load imposed on one of the support rail sections 46 is transmitted in part to an adjacent support rail section and any tendency for undue sideways movement is resisted by the support bodies in which the or each of said adjacent support rail sections is located.

Figure 17:
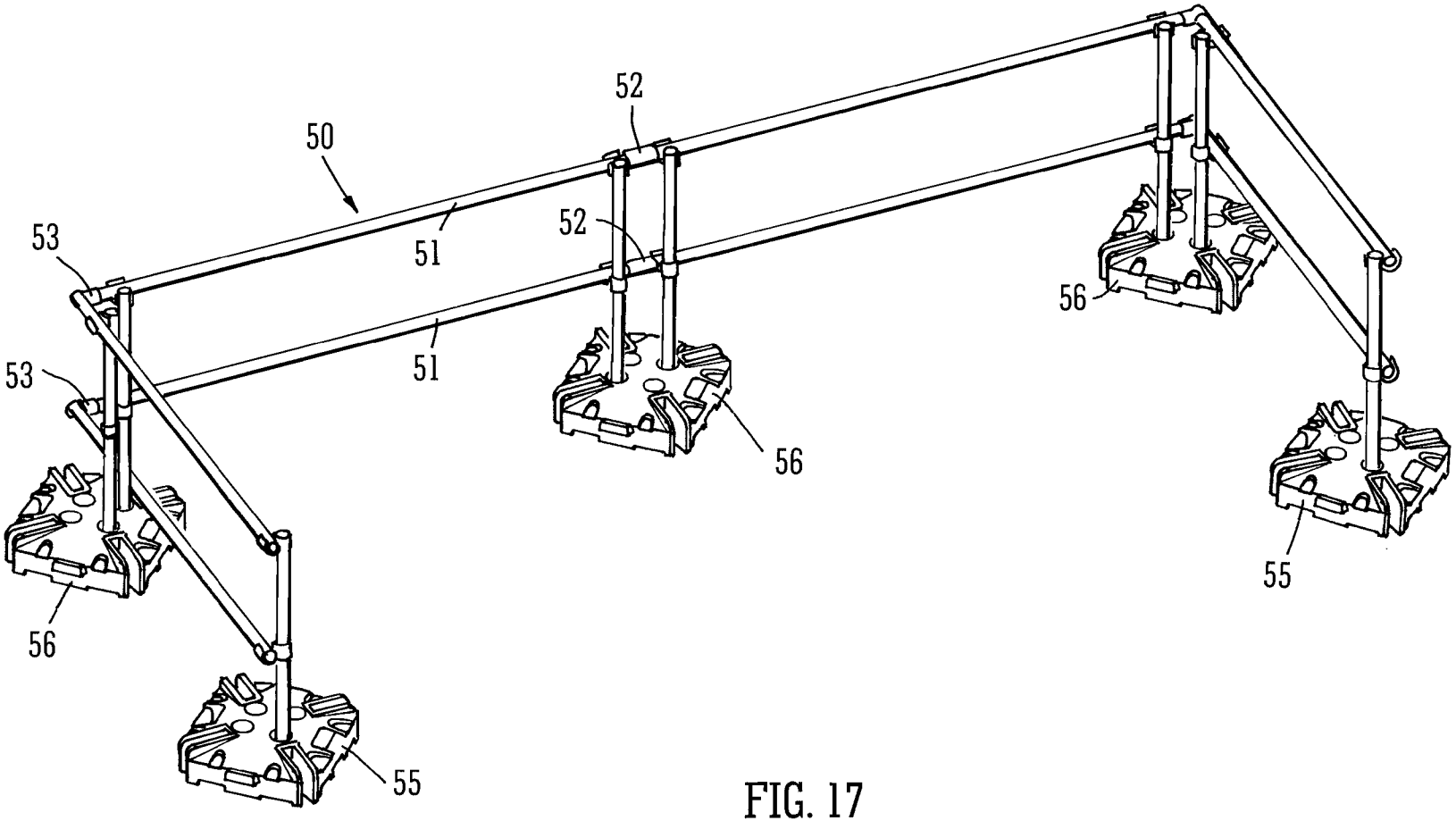
FIG. 17 is a perspective view of a safety rail assembly in accordance with another embodiment of the present invention.

Another form of assembly is shown in FIG. 17. In this assembly 50 the horizontally extending rails 51 are secured together either by in-line connectors 52 or right angle connectors 53, thereby obviating the need to provide the tie bars 47 described in the context of the assembly 45 of FIG. 16. In the assembly of FIG. 17, in which each support foot is of the type described above with reference to FIGS. 1 to 15, connector bolts 18 optionally are provided in each end support foot 55 but are omitted from each intervening support foot 56, each support foot 56 being constrained against relative tilting movement of the upper and lower body sections of the support foot by virtue of the configuration of the assembly 50.

The invention claimed is:

1. A support foot for a modular safety rail system, said support foot being configured to provide a location for a vertical member of a safety rail section, the support foot comprising:

a support body assembly having upper and lower surface regions and an outer periphery, said support body assembly including a first body that is an upper body section which defines said upper surface region, and a second body that is a lower body section which defines said lower surface region, the first and second bodies having at least in part a substantially common outer periphery; and a plurality of location formations positioned inwards of said outer periphery and each extending into the support body assembly from said upper surface for the location of the vertical member of the safety rail section, the location formations each extending through at least material defining the upper body section, at least one of said location formations having associated therewith a retention device configured to secure the vertical member of the safety rail section against removal from the support foot, said retention device comprising a retainer, the two support foot body sections cooperating to hold the retainer captive within the assembly of the two support foot body sections.

2. The support foot according to claim 1, wherein the location formations each extend through the upper body section and at least a part of the thickness of the lower body section.

3. The support foot according to claim 1, wherein each of the two bodies defines a surface which confronts the other of the two bodies, said confronting surfaces each being provided with a formation which in the assembly of the two bodies inter-engages with a complementary formation in the other of the two bodies to maintain the two bodies in alignment when in contact with one another.

4. The support foot according to claim 3 wherein the inter-engaging formations of said confronting surfaces of the two body sections comprise confronting surfaces which, in use, resist tilting of the upper body section relative to the lower body section.

5. The support foot according to claim 1, further comprising connectors configured to secure together the upper and lower body sections.

6. The support foot according to claim 5, wherein each of the bodies is provided with a plurality of location connector apertures which align with apertures in the other body to locate connectors for securing the two bodies relative to one another.

7. The support foot according to claim 1, further comprising at least one slot for location of a toe board, said slot being defined solely by the upper body section.

8. The support foot according to claim 1, further comprising at least one slot for location of a toe board, said slot being defined by both of the upper and lower body sections.

9. The support foot according to claim 1, wherein said retention device comprises a retention aperture which extends from the location formation in an outwards direction towards the outer periphery of the support foot.

10. The support foot according to claim 1, wherein the captive retainer is a tubular sleeve provided within the support foot at a position co-axial with a longitudinal axis of the location formation and through which a vertical member of a safety rail section may extend.

11. The support foot according to claim 10, wherein the tubular sleeve is provided with a screw threaded aperture for a screw which, in use, is configured to be brought to bear firmly against the vertical member of the safety rail section to hold the vertical member captive relative to the support foot.

12. The support foot according to claim 11, wherein the tubular sleeve comprises a boss which surrounds the screw threaded aperture and extends radially outwards from the sleeve to co-operate with abutments defined by the support body and thereby retain the screw threaded aperture of the sleeve aligned with a retention aperture.

13. The support foot according to claim 1, wherein said upper and lower surface regions of the support body assembly respectively comprise inter-engagable formations whereby when one support foot is stacked superimposed on another support foot, said formations resist at least one of sliding movement, toppling movement, or tilting movement of the superimposed support foot relative to the underlying support foot.

14. A modular safety rail assembly, comprising:

two safety rails or safety rail sections each supported by the support foot of claim 1.

15. The modular safety rail assembly according to claim 14, wherein the two safety rail sections are inter-connected by a said support foot and a tie positioned within the upper 30% of the height of the safety rail sections.

16. The modular safety rail assembly according to claim 14, wherein the tie is rigidly secured to at least one of the safety rail sections.

17. A support foot for a modular safety rail system, said support foot being configured to provide a location for a vertical member of a safety rail section, the support foot comprising:

a support body assembly having upper and lower surface regions and an outer periphery, said support body assembly including a first body that is an upper body section which defines said upper surface region, and a second body that is a lower body section which defines said lower surface region, the first and second bodies having at least in part a substantially common outer periphery;

a plurality of location formations positioned inwards of said outer periphery and each extending into the support body assembly from said upper surface for the location of the vertical member of the safety rail section, the location formations each extending through at least material defining the upper body section, at least one of said location formations having associated therewith a retention device configured to secure the vertical member of the safety rail section against removal from the support foot, said retention device comprising a retainer held captive within the assembly of the two support foot body sections, and a retention aperture which extends from the location formation in an outwards direction towards the outer periphery of the support foot; and a slot for location of a toe board, wherein the retention aperture extends to and is accessibly at an end of the slot which lies innermost from the outer periphery of the support foot.

18. A support foot for a modular safety rail system, said support foot being configured to provide a location for a vertical member of a safety rail section, the support foot comprising:

a support body assembly having upper and lower surface regions and an outer periphery, said support body assembly including a first body that is an upper body section which defines said upper surface region, and a second body that is a lower body section which defines said lower surface region, the first and second bodies having at least in part a substantially common outer periphery; and a plurality of location formations positioned inwards of said outer periphery and each extending into the support body assembly from said upper surface for the location of the vertical member of the safety rail section, the location formations each extending through at least material defining the upper body section, at least one of said location formations having associated therewith a retention device configured to secure the vertical member of the safety rail section against removal from the support foot, said retention device comprising a retainer held captive within the assembly of the two support foot body sections, and a passage which is defined by at least one of the upper and lower body sections of the support foot.

* * * * *